United States Patent [19]

Kallenbach

[11] Patent Number: 4,807,318

[45] Date of Patent: Feb. 28, 1989

[54] SUCTION OPERATED CLEANER

[75] Inventor: Dieter H. F. Kallenbach, Chartwell, South Africa

[73] Assignee: Coxwold (Proprietary) Limited, Johannesburg, South Africa

[21] Appl. No.: 112,224

[22] Filed: Oct. 21, 1987

[30] Foreign Application Priority Data

Oct. 21, 1986 [ZA] South Africa ..... 86/7962
Oct. 21, 1986 [ZA] South Africa ..... 86/7963

[51] Int. Cl.[4] ..... E04H 3/20
[52] U.S. Cl. ..... 15/1.7; 15/404; 134/21
[58] Field of Search ..... 15/1.7, 404; 134/21

[56] References Cited

U.S. PATENT DOCUMENTS

| | | | |
|---|---|---|---|
| 1,034,260 | 7/1912 | Lichtenberg | 15/404 X |
| 2,951,257 | 9/1960 | Bodine, Jr. | 15/404 |
| 4,023,227 | 5/1977 | Chauvier | 15/1.7 |
| 4,351,077 | 9/1982 | Hofmann | 15/1.7 |
| 4,642,833 | 2/1987 | Stoltz et al. | 15/1.7 |

*Primary Examiner*—Edward L. Roberts

[57] ABSTRACT

This invention relates to an automatic pool cleaner, particularly suitable for domestic swimming pools which operate on the interruption of an induced flow of water through the cleaner and wherein the control of the interruption is effected through a tubular axially resilient diaphragm one end of which is closed and adapted to hold normally closed a passage from the head of the pool cleaner to the usual form of flexible hose connecting the pool cleaner to the filtration unit.

13 Claims, 2 Drawing Sheets

SUCTION OPERATED CLEANER

BACKGROUND OF THE INVENTION

This invention relates to suction operated cleaners of the type which have been developed to clean domestic swimming pools.

Automatic pool cleaners, operated by the flow of water induced through the cleaner by the pump of the filtration plant, are now becoming well known. Some of these cleaners interrupt the flow of water through the cleaner to induce forces on the cleaner, and the flexible tube connecting it to the filter weir, to move the cleaner in random step-by-step fashion over the floor of the pool. Interruption of flow has been effected by the use of mechanical gates which intermittently block the flow of water through the cleaner to induce these forces. Flexible, tubular, radially contractable diaphragms have also been used to temporarily interrupt flow in order to create inertia caused by the columns of water. Finally, flexible, tubular radially contractable diaphragms have also been used to interrupt the flow of water through the pool cleaners. By making these interruptions of small duration it has been possible to have the cleaner traverse not only horizontal, but vertical submerged surfaces.

Examples of these types of cleaners are described, for example, in U.S. Pat. Nos. 4,351,077, 4,023,227 and 4,642,833.

SUMMARY OF THE INVENTION

According to the present invention, an interruption in the flow of water drawn through a pool cleaner is used to provide a propulsive force to cause the cleaner to move over submerged pool surfaces. A pool cleaner according to the present invention is provided with a hollow head having an inlet adapted to be in close proximity to the surface being cleaned. The cleaner includes an outlet, suitable for connection to a flexible suction hose which leads to the pool filtration plant. A rigid passageway extends through the interior of the cleaner from the head to the outlet. An end of the passageway, proximate the head, is normally closed by an axially resilient tubular diaphragm mounted in the head of the cleaner. One end of the diaphragm is closed to provide a closure member for one end of the rigid passage, and to provide means for subjecting the interior of the diaphragm to variations in the pressure of water flow through the head of the cleaner during use.

In a preferred embodiment of the invention, the means for subjecting the interior of the diaphragm to pressure variations is a second passageway within the cleaner, extending from inside the head to the outlet. In the preferred embodiment, the second passageway is of smaller cross-sectional area than that of the rigid passageway. Alternatively, the second passageway may extend from, and close, the end of the diaphragm while being remote from the rigid passageway, in order to open into the rigid passageway at a point adjacent to the outlet.

The invention also provides for the diaphragm to be in the form of a cylindrical bellows, resiliently biased to an extended position either by the material from which the bellows is made, by a compression spring contained therein, or both. In further accordance with the present invention, the rigid passageway provided in the cleaner may project from the head at an angle of about 45 degrees to the axis of the inlet leading into the head.

DESCRIPTION OF THE PREFERRED EMBODIMENT

Figure 1:
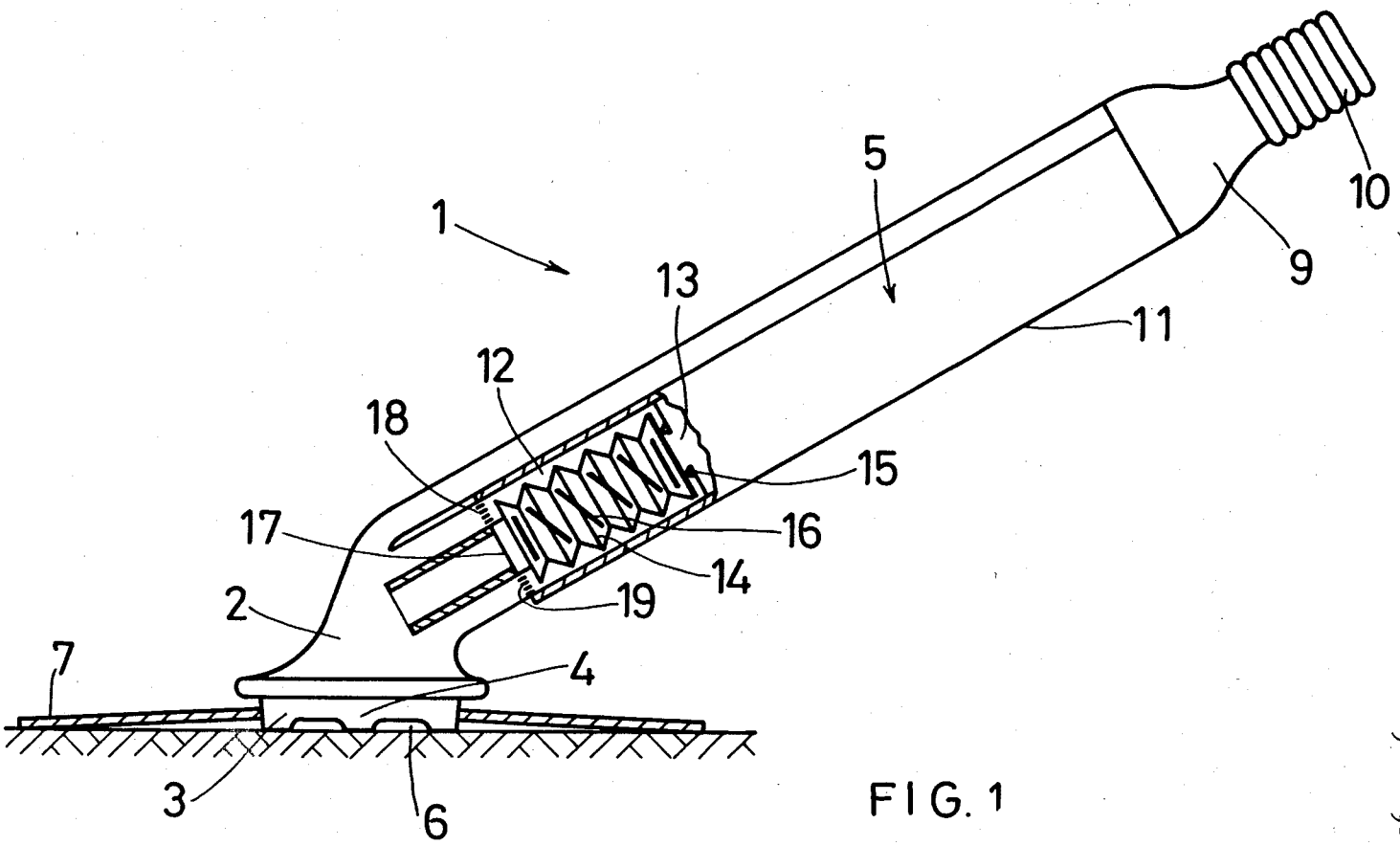
FIG. 1 is a sectional side elevation of one embodiment of this invention.

As illustrated in FIG. 1, a pool cleaner 1 according to the present invention, has a hollow head 2, with a foot 3, adapted to provide contact with the surface to be cleaned. An inlet 4 provides an entrance for water drawn into the head 2 through foot 3. A rigid outlet passageway 5 extends upwardly from the head 2 with its axis at about 45 degrees to the axis of the inlet 4 leading into the head. The foot 3 is provided with openings 6 and a flexible disc 7, rotatable relative to the foot. The flexible disc 7 is rotatable in order to assist in holding the foot against the surface 8 during use.

The outlet passageway 5 provides fluid communication between the interior of the head 2 and a connector 9 to enable the cleaner 1 to be attached to the end of flexible hose 10 which extends to the weir of the pool filter plant. This outlet passageway 5 forms an integral part, in this example, of a cleaner body 11 connecting the head 2 to the connector 9. The connector 9 will enable the hose 10 to swivel with respect to the body 11.

At the lower end of the passageway 5, a chamber 12 is formed having an outlet 13 which allows fluid to pass into the upwardly extending part of passageway 5 to the connector 9. A tubular, axially resilient diaphragm 14, closed with a rigid plate at one end 15, is located in the chamber 12 and houses a compression spring 16. The spring 16 biases the diaphragm to close the outlet 13. The other open end 17 of the diaphragm 14 is supported in the head by a web 18 in such a manner that the interior of the diaphragm 14 is subjected to variations in pressure with the head 2. Openings 19 are made through the web 18 to allow fluid to pass into the chamber 12, outside diaphragm 14 (FIG. 1), from inside the head.

Figure 2:
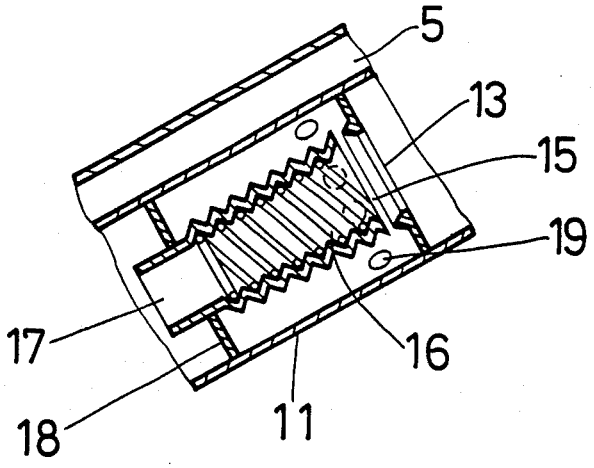
FIG. 2 is a detail of a modification to the embodiment of FIG. 1.

As shown in FIG. 2, openings 19 allow fluid to flow into the head from outside the body. The web 18 in this construction is impervious to pressure variations in the head.

Referring once again to FIG. 1, a second passageway 20, of considerably smaller diameter than the passageway 5, extend upwardly from the head 2 to the connector 9. This second passageway 20 forms part of the body 11. As shown in FIG. 1, the diameter of the second passageway 20 may preferably be about one-fifth that of the passageway 5.

In operation of a pool cleaner 1 according the present invention, flow of pool water is induced through the head 2 and second passageway 20 from the foot 3 by the action of the filter pump. The suction created by the pool water being drawn through the cleaner causes the disc 7 and foot 4 to grip against the floor of the pool in a manner known for a suction type cleaner. However, this suction also acts on the interior of diaphragm 14 causing it to contract and open outlet 13, thereby allowing pool water to flow into the passageway 5.

The water drawn through the second passageway 20 to create this suction also draws water from the interior of diaphragm 14 through open passageway end 17. As the water is drawn from the interior of the diaphragm, the sealed end 15 of the diaphgram 14 is drawn toward the open end 17 of the diaphragm 14, thereby compressing spring 16. This in turn allows fluid to flow through openings 19, past outlet 13, and through passageway 5, to thereby consequently reduce fluid flow through second passageway 20. The result of this is a reduction of the suction force on closed end 15 of diaphragm 14, and a subsequent reclosing of outlet 13 as the spring 16 biases the closed end 15 of the diaphragm 14 into contact with outlet 13. Thereafter, the cycle repeats. Each contraction and expansion of the diaphragm 14 permits stepwise random movement of the cleaner over the surfaces of the pool being cleaned in a manner known by those familiar with interruption-type pool cleaners. The interruption of the flow through the body, by intermittently allowing flow only through the second passageway 20, results in a release of the disc 7 and foot 3 from the surface of the pool, and an impulsive force along the direction of the flexible hose 10 to cause a movement of the cleaner.

Figure 3:
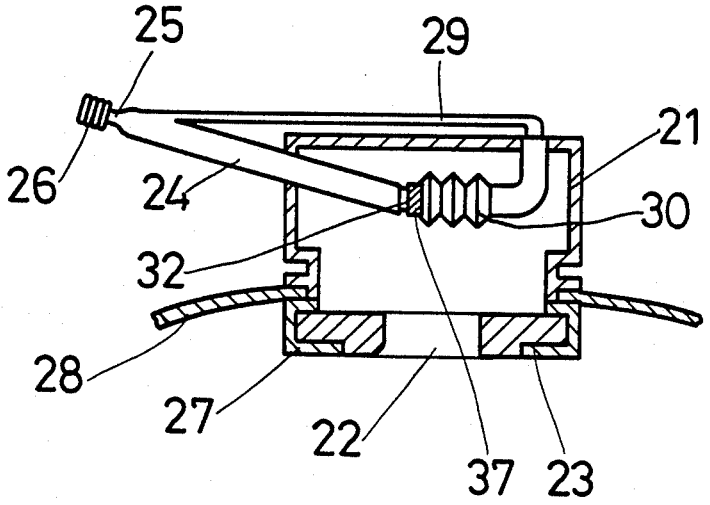
FIG. 3 is a sectional side elevation of another embodiment of the invention.

As illustrated in FIG. 3, another embodiment of an automatic swimming pool cleaner according to the present invention consists essentially of a body 21 having an inlet 22 through the base 23 and an outlet 24 in the form of a rigid passageway inclined at about 45 degrees to the axis of the inlet 22.

The end 25 of the outlet passageway 24 is positioned remote from the body 21 and is adapted to connect, through a swivel (not shown), to a conventional form of flexible suction hose 26 used for pool cleaners.

According to this embodiment, the base 23 will preferably have a replaceable wearing foot 27 and carry a rotatable, flexible disc 28 of known form to assist in maintaining the pool cleaner against the submerged surface which it is to clean (as illustrated in FIG. 1).

Referring again to FIG. 3, the body 21 is provided with a separate tubular connection 29 which extends from the body 21 to the outlet passageway 24, again of a position remote from the body 21 and adjacent the end 25 thereof. An end of the connection 29 extends into the body 21 to be oppositely disposed to the inlet to passageway 24. A resilient tubular diaphragm 30, in the form of a cylindrical bellows, is provided between the end of outlet passageway 24 and the end of the connection 29, and is connected to the conection 29. A free end of the bellows 30, opposite the end connected to connection 29, is closed by a rigid closure member 31 having a resilient facing 32 adapted to seal against the inlet opening of the passageway 24. A light compression spring will preferably be included in the bellows. The spring, and inherent resilience of the diaphragm 30, being designed to give a desired degree of bias to the closure member 31 to tend to hold the inlet to passageway 24 closed.

When the flexible hose 10 is connected to a cleaner 1 according to the present invention and the pump of the filter unit, and when the latter operated, a reduction of pressure or suction will occur in the outlet passageway 24 and the separate connection 29. The dimensions and characteristics ensure that this suction draws the closure member 31 off the inlet to passageway 24 to allow water from the swimming pool to flow through inlet 22 into the body 21 and thence through passageway 24 to the filter unit.

The flow of water through the pool cleaner causes a suction in passageway 24 greater than that in the separate connection 29, the result being that the spring and diaphragm force the closure member 31 toward passageway 24 to close the opening to passageway 24.

This cycle is repeated automatically, each interruption of flow through the body 21 resulting in a force being exerted on the cleaner as well as a substantially simultaneous release of the force holding the cleaner and disc against the submerged surface. The cleaner thus moves in a stepwise manner over the surface to be cleaned in the same way as the embodiment illustrated in FIGS. 1 and 2.

The design of the flexible bellows and resilient facing 32 to the closure member 31 enables most debris to pass through the assembly without causing blockage or interfering with the operation of the cleaner.

It will be understood that both the embodiments described above will require some for or other of balancing mechanism for optimum operation. These mechanisms are known in the art and can easily be designed to suit the requirements of the particular embodiments. Such balancing mechanisms form no part of this invention and thus will not be described herein.

The particular materials, which may conveniently be plastics materials, from which cleaners according to this invention may be built will be chosen along with the dimensions of the cleaners to suit particular requirements. Generally, however, a single size will operate satisfactorily in all domestic swimming pools.

What I claim as new and desire to secure by Letters Patent is:

1. A pool cleaner of the type in which an interruption in the flow of water induced through the cleaner is utilized to provide a propulsive force to cause the cleaner to move over submerged surfaces; wherein the cleaner has a hollow head having an inlet providing a mouth which in use will open in close proximity to the surface being cleaned; and an outlet suitable for connection to a flexible suction hose; a rigid passageway being provided to extend from the interior of the head to the outlet and having that end of the passageway opening into the head normally closed by an axially resilient tubular diaphragm mounted in the head; wherein one end is closed to include a closure member for the rigid passageway and means to enable the diaphragm to respond to pressure variations in water flow through the head during use to intermittently interrupt the flow of water through the pool cleaner to provide said propulsive force.

2. A pool cleaner according to claim 1 wherein the means is a second passageway extending from inside the head to the outlet, said second passageway being defined by a smaller cross sectional area than that of the rigid passageway.

3. A pool cleaner according to claim 2 wherein the diaphragm is mounted in the head to position opposed ends of said diaphragm in such a manner so as to provide said end of said diaphragm including said closure member to allow fluid to flow past the open end thereof into the rigid passageway.

4. A pool cleaner as claimed in claim 1 in which the means is a second passage extending from and closing the end of the diaphragm remote from the rigid passage to open into the rigid passage adjacent the outlet.

5. A pool cleaner as claimed in claim 1 in which the diaphragm is in the form of a cylindrical bellows.

6. A pool cleaner as claimed in claim 5 in which a compression spring is included in the diaphragm.

7. A pool cleaner as claimed in claim 5 in which the material of the bellows provided an inherent bias to hold the bellows in an extended condition.

8. A pool cleaner as claimed in claim 1 in which the rigid passage projects from the head at an angle of about 45 degrees to the axis of the inlet into the head.

9. A pool cleaner adapted to be connectable to a suction line of a conventional pool filtration plant pump, comprised of:

a head, adapted to be engageable with a variety of submerged pool surfaces to be cleaned;

a body portion connected to said head;

an outlet, provided opposite said head on said body, and engageable with a flexible hose leading to said filtration plant pump;

an inlet, within said head, and adapted to allow water to be drawn into said body portion of said cleaner, through said head, when suction is applied to said cleaner through said flexible hose;

a first passageway within said body, providing fluid communication between said inlet in said head and said outlet, said first passageway being defined by a cross sectional flow area;

diaphragm means, provided within said first passageway, to periodically stem the flow of fluid through said first passageway; and a second passageway, within said body, adapted to continuously provide fluid communication between said inlet and said outlet, said second passageway being defined by a cross sectional flow area which is smaller than the cross sectional flow area defining said first passageway.

10. The pool cleaner according to claim 9, wherein said diaphragm means is comprised of an axially resilient diaphragm; said diaphragm being defined by an inner and outer diameter and a pair of opposed ends; said diaphragm being positioned within said first passageway so that a first, open, end of said diaphragm is fixed proximate said inlet of said head, while a second, closed, end of said diaphragm is normally seated against an interior seat surface of said first passageway so that when seated said diaphragm closes said first passageway to inhibit fluid from flowing past said second diaphragm end.

11. The pool cleaner according to claim 10, wherein said first diaphragm end is fixed within said first passageway in such a manner that fluid is allowed to flow past said first end of said diaphragm, and about said outer diameter of said diaphragm, through said first passageway when said second end of said diaphragm is drawn from said seated position.

12. The pool cleaner according to claim 11, wherein spring means is provided to urge said second end of said diaphragm into sealing contact with said seat within said first passageway.

13. A method of propelling a pool cleaner with inertial force caused by periodic disruptions of a flow of water through the cleaner, comprising the steps of:

creating a suction force through a pool cleaner head by drawing water through the head with a conventional pool filter pump;

directing a portion of said suction force through a first passageway provided within said head so that water is drawn through said pool cleaner from said pool and from the interior of a diaphragm positioned within a second passageway extending through said pool cleaner; said diaphragm being provided with a first, open end, fixed within said second passageway, and a second, closed, end normally sealed against a seat provided axially, distally, from said first end of said diaphragm within said second passageway, to normally close said second passageway to the flow of water;

providing spring means to normally bias said diaphragm to said closed position;

drawing said seated end of said diaphragm from the said closed position with said suction force directed through said first passageway in order to draw said second, closed, end of said diaphragm toward said first, open, end of said diaphragm and open said second passageway;

drawing a column of water through said second passageway while said diaphragm is open;

thereafter drawing said second, closed, end of said diaphragm toward the closed, seated, position within said second passageway, thereby creating an independent column of water drawn through said pool cleaner to displace said pool cleaner with its inertia; and repeating the opening and closing of said diaphragm by the continuous suction force drawn through said first passageway.

* * * * *

UNITED STATES PATENT AND TRADEMARK OFFICE

CERTIFICATE OF CORRECTION

PATENT NO. : 4,807,318

DATED : February 28, 1989

INVENTOR(S) : Dieter Kallenbach

It is certified that error appears in the above-identified patent and that said Letters Patent is hereby corrected as shown below:

Column 3, line 3: "diaphgram" should be -- diaphragm --;
line 47: "conection" should be -- connection --.

Signed and Sealed this

Thirtieth Day of June, 1992

*Attest:*

DOUGLAS B. COMER

*Attesting Officer*

*Acting Commissioner of Patents and Trademarks*